US011589629B2

(12) United States Patent
Jacobsen

(10) Patent No.: US 11,589,629 B2
(45) **Date of Patent: *Feb. 28, 2023**

(54) MULTI-BODY HELMET CONSTRUCTION AND STRAP ATTACHMENT METHOD

(71) Applicant: BELL SPORTS, INC., Scotts Valley, CA (US)

(72) Inventor: Gregg T. Jacobsen, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 187 days.

This patent is subject to a terminal disclaimer.

(21) Appl. No.: 17/119,455

(22) Filed: Dec. 11, 2020

(65) Prior Publication Data

US 2021/0093034 A1 Apr. 1, 2021

Related U.S. Application Data

(63) Continuation of application No. 16/028,360, filed on Jul. 5, 2018, now Pat. No. 10,881,161, which is a (Continued)

(51) Int. Cl.
*A42B 3/06* (2006.01)
*A42B 3/08* (2006.01)

(Continued)

(52) U.S. Cl.
CPC ..... *A42B 3/06* (2013.01); *A42B 3/066* (2013.01); *A42B 3/08* (2013.01); *A42B 3/12* (2013.01);

(Continued)

(58) Field of Classification Search
CPC ..... A42B 3/06; A42B 3/066; A42B 3/08; A42B 3/12; A42B 3/128; A42B 3/147; A42B 3/221; A42B 3/283
See application file for complete search history.

(56) References Cited

U.S. PATENT DOCUMENTS 4,932,076 A * 6/1990 Giorgio ..... A42B 3/10 2/5
5,044,016 A * 9/1991 Coombs ..... A42B 3/04 2/5
5,123,121 A * 6/1992 Broersma ..... A42B 3/066 24/200
5,272,773 A * 12/1993 Kamata ..... A42B 3/08 2/421

(Continued)

*Primary Examiner* — Khaled Annis
(74) *Attorney, Agent, or Firm* — Walter M. Egbert, III; Richard J. Brown; Reed Smith LLP

(57) ABSTRACT

A helmet may include an upper-body comprising a first outer shell coupled to a first energy-absorbing shell formed of expanded polypropylene (EPP), expanded polystyrene (EPS), expanded polyurethane (EPU), or expanded polyolefin (EPO). A lower-body may include a second outer shell coupled to a second energy-absorbing shell formed of EPP, EPS, EPU, or EPO, wherein an upper portion of the lower-body is nested within the upper-body and a lower portion of the lower-body extends to an outer surface of a lower portion of the upper-body. A strap anchor may be disposed between the upper-body and the lower-body, and be sandwiched between the upper-body and the lower-body with the strap anchor being adjacent to, and oriented towards, the lower-body. A strap may be coupled to the fastening device and coupled to the strap anchor for coupling the helmet to a head of a user.

20 Claims, 7 Drawing Sheets

Related U.S. Application Data continuation of application No. 14/640,148, filed on Mar. 6, 2015, now Pat. No. 10,016,007.

(60) Provisional application No. 61/949,924, filed on Mar. 7, 2014.

(51) Int. Cl.

| | |
|---|---|
| ***A42B 3/12*** | (2006.01) |
| ***A42B 3/22*** | (2006.01) |
| ***A42B 3/28*** | (2006.01) |
| ***A42B 3/14*** | (2006.01) |

(52) U.S. Cl.

CPC ..... *A42B 3/128* (2013.01); *A42B 3/147* (2013.01); *A42B 3/221* (2013.01); *A42B 3/283* (2013.01)

(56) References Cited

U.S. PATENT DOCUMENTS

| | | | | |
|---|---|---|---|---|
| 5,517,691 | A * | 5/1996 | Blake | A42B 3/32 2/418 |
| 5,581,819 | A * | 12/1996 | Garneau | A42B 3/085 2/421 |
| 6,983,488 | B2 * | 1/2006 | Foote | A42B 3/003 2/9 |
| 8,091,148 | B2 * | 1/2012 | Ho | A42B 3/04 2/412 |
| 2002/0116749 | A1 * | 8/2002 | Bielefeld | A42B 3/14 2/416 |
| 2007/0083986 | A1 * | 4/2007 | Kaiser | A42B 3/08 2/410 |
| 2010/0281603 | A1 * | 11/2010 | Ho | A42B 3/08 2/421 |

* cited by examiner

MULTI-BODY HELMET CONSTRUCTION AND STRAP ATTACHMENT METHOD

RELATED APPLICATIONS

This application is a continuation of U.S. application Ser. No. 16/028,360, filed Jul. 5, 2018 and issued as U.S. Pat. No. 10,881,161 on Jan. 5, 2021, which is a continuation of U.S. application Ser. No. 14/640,148, filed Mar. 6, 2016 and issued as U.S. Pat. No. 10,016,007 on Jul. 10, 2018, which claims the benefit of U.S. provisional patent application 61/949,924, filed Mar. 7, 2014, the entirety of the disclosures of which are incorporated herein by this reference.

TECHNICAL FIELD

This disclosure relates to a helmet comprising multi-body helmet construction and a strap attachment device and method usable with the multi-body helmet. The multi-body helmet can be employed wherever a conventional helmet is used with additional benefits as described herein.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

For helmet-wearing athletes in many applications, such as sports, beyond the safety aspects of the protective helmet, additional considerations can include helmet fit and airflow through the helmet. Improvements in fit comfort and airflow can reduce distractions to the athlete and thereby improve performance. The multi-body helmet construction and a strap attachment device, as disclosed in this document, relate to safety, as well as improvements in fit, airflow, and comfort without reducing safety for customers.

An aspect of providing a proper fit between a user's head and the helmet can include the straps that are used to couple the helmet to the head of the user. FIG. 1 shows a strap anchor or ski type strap anchor 10 that has been conventionally used for in-molded helmets, including ski helmets or other snow helmets, for coupling a strap to the in-molded helmet. The strap anchor 10 can comprise two basic portions, i) a strap anchor body 14, which can include the opening 12 and ii) a web, reinforcing attachment, fins, parachutes, anchoring geometry, or reinforcing attachment point 16 that couples the strap anchor 10 to a helmet or helmet body.

The opening 12 of the strap anchor 10 can receive a strap can be inserted into the opening to couple the strap to the strap anchor 10. Afterwards, the strap can then couple the ski helmet to a head of a user. When the strap anchor 10 is coupled to the helmet, the web 16 of the strap anchor 10 can be disposed within an energy-absorbing material or layer of the helmet, such as a layer of expanded polystyrene (EPS) foam or other suitable material. The web 16 can be sufficiently large, and include sufficient anchoring geometry, to secure the strap anchor 10 to the helmet by fixing the web 16 within the energy-absorbing material and remain firmly coupled during impacts. When the ski anchor 10 is coupled to a helmet body, the web 16 can be imbedded within the helmet body.

The strap or webbing of the helmet can be coupled to the strap anchor 10 by forming a loop in an end of the strap and inserting a pin through the loop of strap. Then, the pin and the loop of the strap can be passed through the opening 12 and disposed within the strap anchor body 14. When the strap is coupled to the strap anchor 10, the strap anchor body 14 is conventionally disposed at an edge of the helmet to allow for access to the opening 12. As such, at least a portion of the strap anchor 10, and particularly at least a portion of the strap anchor body 14, remains visible to the helmet user and others observing the user wearing the helmet.

SUMMARY

A need exists for helmet strap attachment and methods for providing the same. Accordingly, in an aspect, a helmet can comprise an upper-body comprising an upper outer shell and an upper energy-absorbing material coupled the upper outer shell. The helmet can comprise a lower-body comprising a lower outer shell and a lower energy-absorbing material coupled the outer shell, wherein the lower-body is nested within the upper-body. The helmet can comprise a strap anchor formed without a web and embedded within the upper-body or the lower-body between the upper-body and the nested lower-body. The helmet can also comprise a strap coupled to the strap anchor, wherein the strap extends between the upper-body and the lower-body and is threaded through the lower-body to couple the helmet to a head of a user.

The helmet can further comprise the strap anchor comprising a size less than or equal to 10-30 millimeters (mm), by 10-50 mm, by 2-10 mm. The strap anchor can also be disposed within the upper-body such that a strap anchor opening is substantially coplanar with an inner surface of the upper-body and offset from a lower edge of the upper-body. The upper energy absorbing material can comprise expanded polypropylene (EPP), expanded polystyrene (EPS), expanded polyurethane (EPU), or expanded polyolefin (EPO), and the lower energy absorbing material can comprise EPP, EPS, EPU, or EPO. The upper energy absorbing material can comprise a density in a range of 70-100 g/L, and the lower energy absorbing material can comprise a density in a range of 50-80 g/L. The strap anchor can be sandwiched between the upper-body and the lower-body and hidden from view within the helmet. The strap anchor can also be positioned within the helmet to reduce twisting of the strap used for coupling the helmet to the head of the user.

In another aspect, a helmet can comprise an upper-body comprising an upper outer shell and an upper energy-absorbing material coupled the upper outer shell. The helmet can comprise a lower-body comprising a lower outer shell and a lower energy-absorbing material coupled the outer shell, wherein the lower-body is nested within the upper-body. The helmet can comprise a strap anchor embedded within the upper-body or the lower-body and disposed between the upper-body and the nested lower-body. The helmet can also comprise a strap coupled to the strap anchor, wherein the strap that extends between the upper-body and the lower-body and is threaded through the lower-body to couple the helmet to a head of a user.

The helmet can further comprise the strap anchor comprising a size less than or equal to 10-30 mm, by 10-50 mm, by 2-10 mm. The strap anchor can also be formed without a web. The strap anchor can also be disposed within the upper-body such that a strap anchor opening is substantially coplanar with an inner surface of the upper-body and offset from a lower edge of the upper-body. The upper energy absorbing material can comprise EPP, EPS, EPU, or EPO, and the lower energy absorbing material can comprise EPP, EPS, EPU, or EPO. The strap anchor can also be sandwiched between the upper-body and the lower-body and hidden from view within the helmet.

In another aspect, the helmet can further comprise an upper-body comprising an upper energy-absorbing material, a lower-body comprising a lower energy-absorbing material, a strap anchor disposed between the upper-body and the lower-body, and a strap coupled to the strap anchor, wherein the strap extends between the upper-body and the lower-body for coupling the helmet to a head of a user.

The helmet can further comprise the strap anchor comprising a size less than or equal to 10-30 mm, by 10-50 mm, by 2-10 mm. The strap anchor can be formed without a web. The strap anchor can be disposed within the upper-body such that a strap anchor opening is substantially coplanar with an inner surface of the upper-body and offset from a lower edge of the upper-body. The upper energy absorbing material can comprise expanded EPP, EPS, EPU, or EPO, and the lower energy absorbing material can comprise EPP, EPS, EPU, or EPO. The upper energy absorbing material can comprise a density in a range of 70-100 g/L, and the lower energy absorbing material can comprise a density in a range of 50-80 g/L. The strap anchor can be sandwiched between the upper-body and the lower-body and hidden from view within the helmet.

DETAILED DESCRIPTION

Figure 1:
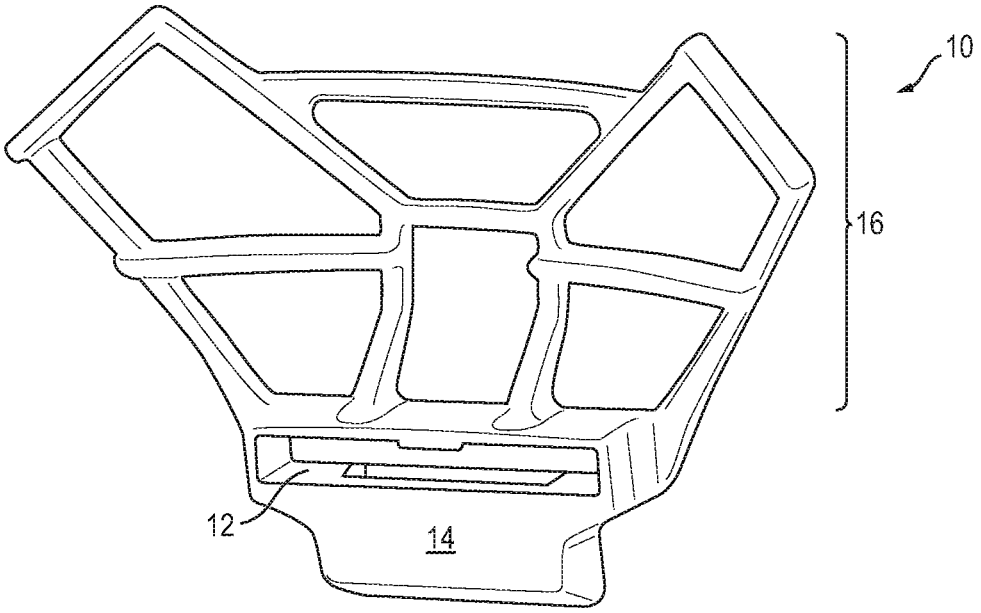
FIG. 1 (PRIOR ART)
FIG. 1 shows a view of a ski-type anchor device as known in the prior art.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a protective helmet that can include an outer shell and an inner energy-absorbing layer, such as foam. The protective helmet can be a bike helmet used for mountain biking or road cycling, as well as be used for a skier, skater, hockey player, snowboarder, or other snow or water athlete, a football player, baseball player, lacrosse player, polo player, climber, auto racer, motorcycle rider, motocross racer, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a helmet that includes either single or multi-impact rated protective material base that is typically, though not always, covered on the outside by a decorative cover and includes comfort material on at least portions of the inside, usually in the form of comfort padding.

Generally, protective helmets, such as the protective helmets listed above, can comprise an outer shell and in inner energy-absorbing material. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising in-molded helmets, the disclosure also relates and applies to hard-shell helmets.

Figure 2A:
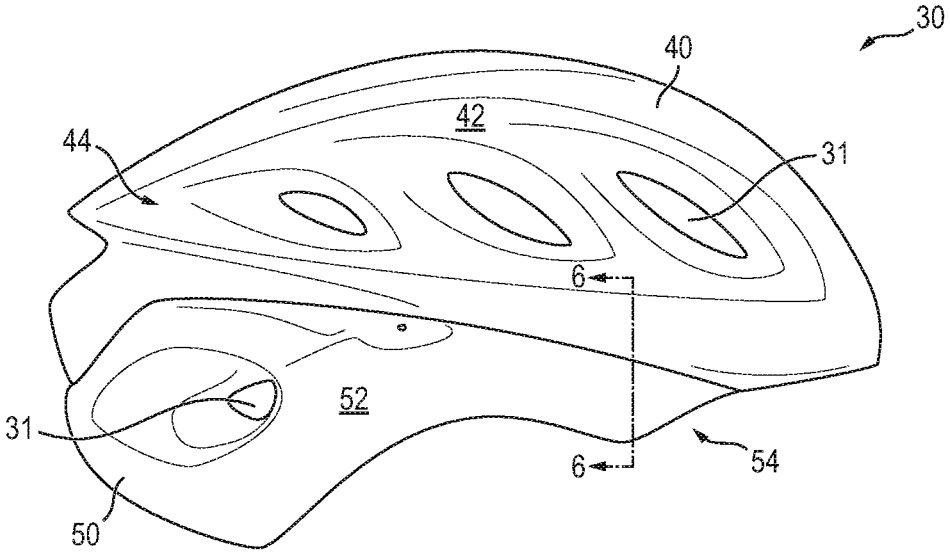
FIGS. 2A and 2B show side views of an embodiment of a multi-body helmet.
Figure 2B:
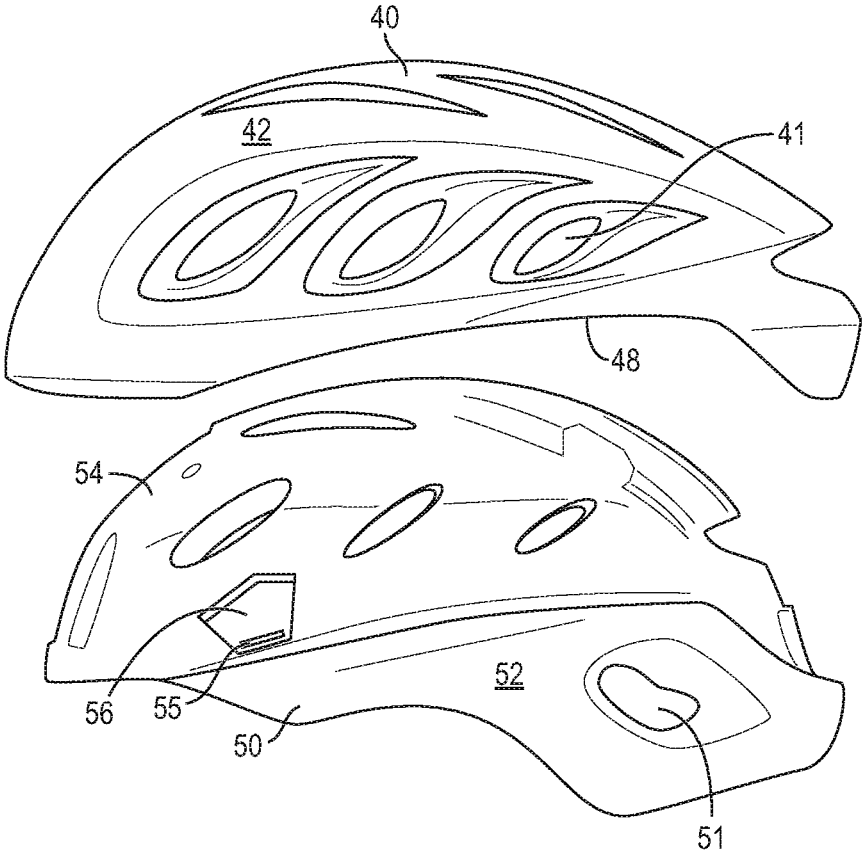

FIGS. 2A and 2B show side profile views of a non-limiting example of a multi-body helmet 30 that comprises vents or openings 31 and an upper-body 40 and a lower-body 50. For convenience, the multi-body helmet 30 is referred to throughout the application as a two-body helmet, or bifurcated helmet, comprising the upper-body 40 and a lower-body 50, or first and second bodies or portions. However, the present disclosure encompasses multi-body helmets that comprise more than two bodies, such as three, four, or any suitable number of bodies. The upper-body 40 and the lower-body 50 can be joined to form a single multi-body helmet 30, as shown in FIG. 2A, which is a departure from the conventional single body helmets described generally above. FIG. 2B shows the upper-body 40 and the lower-body 50 of the multi-body helmet 30 vertically separated by a gap or space while aligned with respect to each other, such as before the upper-body 40 and the lower-body 50 are placed in contact and adjacent each other.

The upper-body 40 can comprise an outer shell 42 and an energy-absorbing layer or impact liner 44, although the upper-body 40 need not have both. For example, in some embodiments the upper-body 40 can comprise the energy-absorbing layer 44 without the outer shell 42. Vents or openings 41 can be formed in the upper-body 40 that form, comprise, or align with at least a portion of the vents 31. Similarly, the lower-body 50 can comprise an outer shell 52 and an energy-absorbing layer or impact liner 54, although the lower-body 50 need not have both. For example, in some embodiments the lower-body 50 can comprise the energy-absorbing layer 54 without the outer shell 52. Vents or openings 51 can be formed in the lower-body 50 that form, comprise, or align with at least a portion of the vents 31, vents 41, or both.

The outer shells 42 and 52 can each, without limitation, be formed of a plastic, resin, fiber, or other suitable material including polycarbonate (PC), polyethylene terephthalate (PET), acrylonitrile butadiene styrene (ABS), polyethylene (PE), polyvinyl chloride (PVC), vinyl nitrile (VN), fiberglass, carbon fiber, or other similar material. The outer shells 42 and 52 can be stamped, in-molded, injection molded, vacuum formed, or formed by another suitable process. Outer shells 42 and 52 can provide a shell into which the energy-absorbing layers 44 and 54, respectively, can be in-molded. Outer shells 42 and 52 can also provide a smooth aerodynamic finish, a decorative finish, or both, for improved performance, improved aesthetics, or both. As a non-limiting example, the outer shells 42 and 52 can comprise PC shells that are in-molded in the form of a vacuum formed sheet, or are attached to the energy-absorbing layers 44 and 54, respectively, with an adhesive. The outer shells 42 and 52 can also be permanently or releasably coupled to the energy-absorbing layers 44 and 54, respectively, using any suitable chemical or mechanical fastener or attachment device or substance including without limitation, an adhesive, permanent adhesive, pressure sensitive adhesive (PSA), foam-core adhesive, tape, two-sided tape, mounting foam adhesive, fastener, clip, cleat, cutout, tab, snap, rivet, hog ring, or hook and loop fasteners.

The energy-absorbing layers 44 and 54 can each be disposed inside, and adjacent, the outer shells 42 and 52, respectively. The energy-absorbing layers 44 and 54 can be made of plastic, polymer, foam, or other suitable energy-absorbing material or impact liner to absorb, deflect, or otherwise manage energy and to contribute to energy management for protecting a wearer during impacts. The energy-absorbing layers 44 and 54 can include, without limitation, EPP, EPS, EPU, EPO, or other suitable material. As indicated above, in-molded helmets can be formed with the outer shell of the helmet being bonded directly to the energy-absorbing layer by expanding foam into the outer shell. As such, the energy-absorbing layers 44 and 54 can, in some embodiments, be in-molded into outer shells 42 and 52, respectively, as single monolithic bodies of energy-absorbing material. Alternatively, in other embodiments the energy-absorbing layers 44 and 54 can be formed of multiple portions or a plurality of portions. In any event, the energy-absorbing layers 44 and 54 can absorb energy from an impact by bending, flexing, crushing, or cracking.

By forming the multi-body helmet 30 with multiple bodies or portions, such as upper-body 40 and lower-body 50, the multi-body helmet 30 can advantageously and easily provide a multiple density design. For example, the upper-body 40 and the lower-body 50 can be formed of energy-absorbing materials of different densities and energy management properties, wherein the energy-absorbing material 44 can comprise a first density, and the energy-absorbing material 54 can comprise a second density different from the first density. The first density can be greater than or less than the first density. In an embodiment, the energy-absorbing material 44 can comprise a density in a range of 70-100 g/L and the energy-absorbing material 54 can comprise a density in a range of 50-80 g/L. Additionally, multiple layers of varying density, including increasing density, decreasing density, or mixed density, can be combined. By forming a single multi-body helmet 30 that comprises a plurality of densities for a plurality of bodies or components, helmet performance including helmet weight, and testing performance, can be manipulated and optimized with greater freedom and fewer restrictions than is available with a single bodied helmet.

By forming the multi-body helmet 30 with multiple interlocking bodies or portions, such as upper-body 40 and lower-body 50, the multi-body helmet 30 can also provide increased design flexibility with respect to conventional one-body or monolithic protective helmets. Increased design flexibility can be achieved by forming the upper-body 40 and the lower-body 50 comprising shapes, geometric forms, and orientations that would be difficult to accomplish with a single body liner. Constraints restricting shapes, geometric forms, and orientations of a single body liner include constraints for injecting foam or energy-absorbing material into a mold, constraints of removing the molded foam or energy-absorbing material from the mold, and constraints of machining or removing the single body liner from a template or standard blank of material such as a block of energy-absorbing material. For example, use of multiple interlocking body pieces for a single helmet can allow for helmet shapes, geometric forms, and orientations that would be difficult or impossible to remove or pull from a 1-piece mold. As a non-limiting example, increased design flexibility with respect to helmet shape for the multi-body helmet 30 can include a helmet comprising a curvature or profile that follows a contour of the occipital region or occipital curve of user's head. Furthermore, increased design flexibility can be achieved because forming the multi-body helmet 30, including upper-body 40 and lower-body 50, can simplify assembly of energy-absorbing material at an EPS press.

By forming the multi-body helmet 30 with multiple bodies or portions, such as the upper-body 40 and the lower-body 50, the multi-body helmet 30 can also provide advantages with respect to the attachment and positioning of straps or webbing 70 that can be used to couple or releasably attach the multi-body helmet 30 to a user's head. For example, FIG. 2B shows the multi-body helmet 30 can comprise a space, gap, or void between the upper-body 40 and the lower-body 50, into which the straps 70 can be nested or concealed. FIG. 2B shows a non-limiting example in which the outer shell 52 can be limited to a lower portion of the lower-body 50 that will not be covered or will remain exposed with respect to outer shell 42 of upper-body 40. As such, the upper portion of the lower-body 50 can be formed without outer shell 52, and can include a strap opening 55 that can be formed through the energy-absorbing material 54 and can be configured of a size that allows for a portion of the strap 70 to pass from the upper-body 40, through the lower-body 50, to secure the multi-body helmet 30 the user's head. The upper portion of the lower-body 50 can be formed with a strap recess 56 adjacent, or comprising, the strap opening 55. The strap recess 56 can direct an alignment and location of the strap 70 as it passes from a strap anchor 60, through portions of the multi-body helmet, to a head of the helmet user. Additional detail of how the straps 70 can be included within, and coupled to, the multi-body helmet 30 are shown in, and discussed with respect to, the subsequent figures.

The multi-body helmet 30 can also provide advantages with respect to a strap anchor 60 being concealed or hidden within the multi-body helmet 30. Additionally, and as a non-limiting example, in some instances additional advantages of the multi-body helmet 30 can include the strap anchor 60 being smaller than conventional strap anchors, such as strap anchor 10 shown in FIG. 1. More specifically, the strap anchor 60 can be formed without a web 16, such as, although in other embodiments a web can be included. Thus, in some instances the strap anchor 60 can be reduced in size by omitting the webs 16. Strap anchors can retain sufficient strength while being decreased in size for a number of reasons. First, an entrapping effect of the strap 70 between the upper-body 40 and the lower-body 50 can reduce a force applied on the strap anchor 60 itself, thereby reducing the need for a web. Next, the strap 70 can be fed through a slot or opening in one or more of, the upper-body 40, the outer shell 42, the lower-body 50, or the outer shell 22, to provide strength similar to that provided by the conventional anchor 10 or strap bone, where a majority of resistance strength can come from an outer shell such as a PC cap. As such, the strap anchor 60 can differ from a conventional strap bone or strap anchor, like strap anchor 10, by being embedded within the multi-body helmet 30, and by not being visible to a user at an outer surface or exposed surface of the multi-body helmet 30. Various examples of the strap anchor 60 are shown in, and discussed with respect to, FIGS. 3-6.

Figure 3:
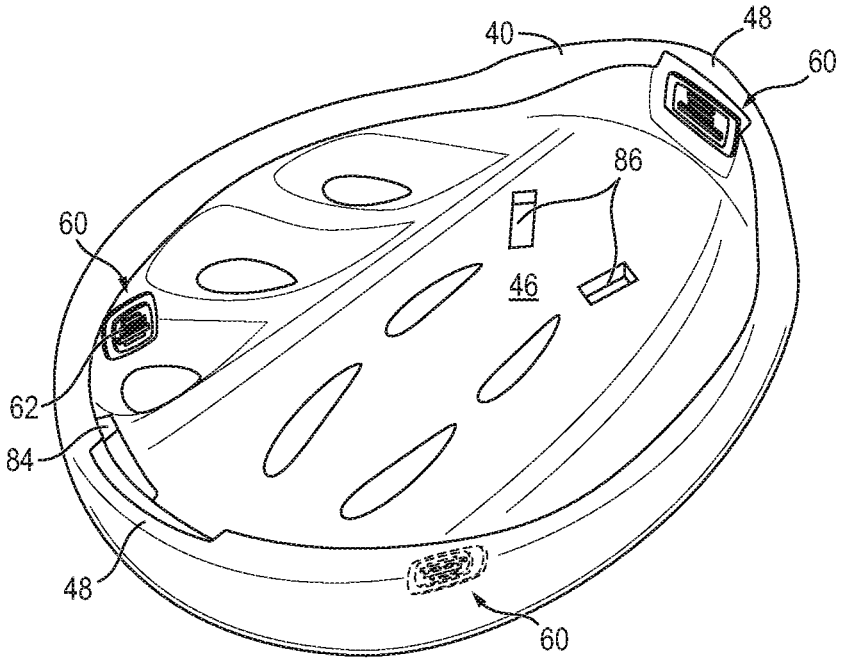
FIG. 3 shows a perspective view of an upper-body of a multi-body helmet.

FIG. 3 shows a perspective view of the upper-body, in which the strap anchors are visible and shown embedded within the energy-absorbing layer 44. Thus, the relative number and positions of the strap anchors can vary, but as a non-limiting example, are shown in FIG. 3 to include two front strap anchors 60 and a rear strap anchor 60 configured to receive straps 70 as part of the strapping system for releasably coupling the helmet 30 to a user's head. FIG. 3 shows one of the front strap anchors 60, which would otherwise be obscured by the upper-body 40, in dashed lines to indicate an approximate relative position of the strap anchor 60 as positioned on the inner surface 46 of the upper-body 40. While FIG. 3 shows an embodiment in which a single strap anchor 60 is being used, the multi-body helmet 30 can also comprise two rear strap anchors 60, any desirable number and orientations of strap anchors 60 can be used. The strap anchors 60 can be disposed within the energy-absorbing material 44 such that the strap anchors 60 reside on the inner surface 46 of the upper-body 40 and are not visible, or can be completely blocked from view, from the outer side of the upper-body 40. Whatever the number and position of strap anchors 60, the strap anchors 60 can be positioned and arranged, oriented, or aligned, at a relative angle of about 90 degrees, such as plus or minus 0-20 degrees, to an applied load or an expected applied load. As such, the straps 70 can releasably couple the helmet 30 to the user's head while the straps 70 can be oriented to lie flatter on the face of the user, and to reduce or minimize twisting of the straps 70.

While FIG. 3 shows that the strap anchors 60 can be exposed at the inner surface 46 of the upper-body 40, the strap anchors 60 can also be wholly hidden from view within the multi-body helmet 30 when the lower-body 50 is coupled to, or nested within, the upper-body 40. FIG. 3 also shows that the strap anchors 60 can comprise an opening, slot, notch, channel, keyhole, or other suitable receiving apparatus 62 within the strap anchor for securely coupling the strap 70 to the strap anchor 60. More specifically, the strap anchors 60 can be hidden from view within the multi-body helmet 30 by being placed with openings 62 of the strap anchors 60 at, co-planar with, or substantially co-planar with, an inner surface 46 of the upper-body 40. As used herein, the strap anchor 60 or the opening 62 of the anchor 60 can be substantially co-planar with the inner surface of the upper-body 40 when the strap anchor 60 or the opening 62 of the anchor 60 are offset by a distance less than or equal to 10 millimeters (mm), 5 mm, 3 mm, 2 mm, 1 mm or less than 1 mm. The openings 62 of the strap anchors 60 can be the portion of the anchor 60 through which the strap 70 exits the strap anchor 60 to hold the helmet 30 to the user's head. As shown in FIG. 3, the strap anchors 60 can be embedded in energy-absorbing layer 44 with the openings 62 exposed away from lower edges 48 the upper-body. As such, the openings 62 of anchors 60 can be positioned along the inner surface 46 of upper-body 40 so as to be sandwiched between the upper-body 40 and the lower-body 50. Thus, the strap anchors 60 need not be in-molded on an inner surface of a helmet as the conventional strap anchors 10 would be. Furthermore, in contrast to the conventional strap anchors 10 that would be exposed for receiving a pin and webbing loop, as well as being visible to a user and subject to disassembly by the user, the strap anchors 60 can be concealed from the user and thus be tamper-proof.

Figure 4A:
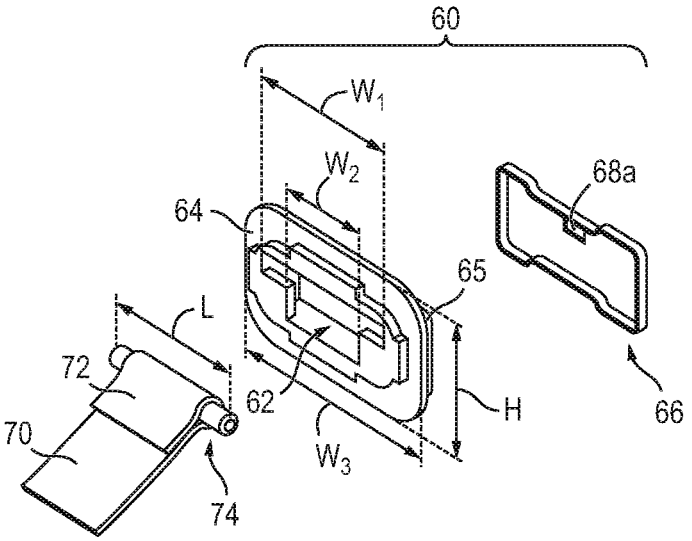
FIGS. 4A-4E show various views of an anchor housing, a cover for the anchor housing, a strap, and a strap rod.

FIGS. 4A-4E show additional detail of a non-limiting example of the strap anchor 60. FIG. 4A shows the strap anchor 60 can comprise the opening 62 formed in the anchor body or housing 64 to accommodate, and be coupled to, the strap 70. The strap 70 can be coupled to the strap anchor 60 by placing a fastening device such as a rod, hook, button, key, or other suitable device 74 coupled to the strap 70, such as passing through a loop 72 in an end of the strap 70. While FIGS. 4A-4E show additional detail of a non-limiting example in which the rod 74 is formed as a rod, pin, cylinder, or pillar, the rod 74 and the mateable or receiving portion for the rod 74, such as the opening 62 in the strap cover 60, can comprise a cul-de-sac design, or a key-hole slide lock design in which the webbing end employs a plastic part shaped like a button, the button fitting into the strap anchor housing, which is shaped with an appropriate key-hole slot to receive it as the button is pulled into a locked position during assembly.

Accordingly, when the rod is formed as a rod, pin, cylinder, or pillar, the rod 74 can comprise a length L that is less than a width W1 of the opening 62 for receiving the rod 74. The length L or the rod 74 can comprise a distance that is greater than a width W2 of the opening 62 for retaining the rod 74 within the anchor body 64 after the rod 74 has passed through he opening 62. As a non-limiting example, the width W1 can be positioned at a top of the opening 62 and the width W2 can be positioned at a bottom of the opening 62. More specifically, the rod 74 can be fitted into the opening 62 such that the rod 74 and the opening 62 can be coupled or locked together with the rod being tucked down into a locking position within the anchor body 64. The opening 62 can further comprise tabs, knobs, notches, gates, latches, or other fastening devices inside or in conjunction with the opening 62 or the anchor housing 64 that can prevent the rod 74 from undesirably or unintentionally coming out from the opening 62, thereby ensuring proper assembly, attachment, or both, of the rod 74 and the opening 62.

In addition to the rods 74 being used to secure loops 72 of strap 70 within strap anchors 60, different kinds of mounting systems for coupling the strap anchor 60 and the strap 70 can also be used. While use of rods or metal pins have been used in other helmets, including ski helmets, and can be adapted to use within the multi-body helmet 30 disclosed herein, persons of ordinary skill in the art will readily understand that other anchor devices are also contemplated. Thus, any method for securing the ends of the straps 70 to the strap anchors 60 can be used, and advantageously, can hide the strap anchors 60 from the consumer or user, as made possible by the multiple bodies of the multi-body helmet 30. While the strap anchors 60 can be in-molded into an energy-absorbing layer such as energy-absorbing layer 44 during an in-molding process, the loop 72 of the strap 70 and the rod 74 can be subsequently disposed within the strap anchor 60 as described in greater detail below.

FIG. 4A also shows a non-limiting example in which the strap anchor 60 can comprise a cover or strap anchor cover 66 sized and configured to be coupled to, and disposed over, an open outer edge 65 of the anchor body 64 opposite the opening 62. While in some embodiments the strap anchor 60 can comprise multiple discrete or separately formed pieces to facilitate formation or molding, such as the cover 66 and the anchor body 64, in other embodiments, the strap anchor 60 can comprise a single integrally formed body, piece, or unit. For example, FIG. 4A shows separate discrete portions of the strap anchor 60 and the anchor body 64 formed with an open back to accommodate tooling of the anchor body 64. When the strap anchor is formed of multiple bodies, such as with the anchor body 64 and the cover 66, the anchor body 64 and the cover 66 can be coupled together using any suitable chemical or mechanical fastener or attachment device or substance including without limitation, an adhesive, permanent adhesive, PSA, foam-core adhesive, tape, two-sided tape, mounting foam adhesive, fastener, clip, cleat, cutout, tab, snap, rivet, hog ring, or friction fit based on geometries of the anchor body 64 and the cover 66. In some embodiments, the anchor body 64 and the cover 66 can be coupled together by snapping together the anchor body 64 and the cover 66 as shown in FIG. 4B.

Figure 4B:
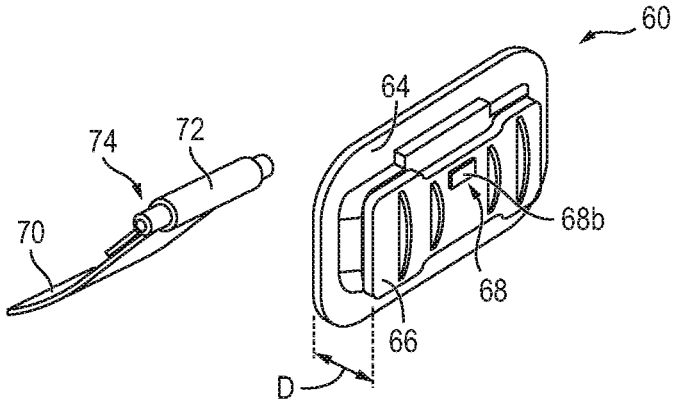

FIG. 4B shows a perspective view of the strap anchor 60, the strap 70, and the rod 74 similar to that shown in FIG. 4A. FIG. 4B differs from FIG. 4A by the angle of the view that shows the opening 62 in the strap anchor 60 oriented away from the viewer and further shows the cover 66 in place on the anchor body 64. As a non-limiting example, the cover 66 can be coupled to the anchor body 64 and held together by an engagement snap 68. The engagement snap 68 can comprise an engagement snap opening 68*a* and an engagement snap prong 68*b*. As a non-limiting example, the FIG. 4A shows the engagement snap opening 68*a* can be formed in the cover 66 and the engagement snap prong 68*b* can be formed as part of the anchor body 64. However, the portions of the engagement snap 68 can also be reversed so that the engagement snap opening 68*a* can be formed in the anchor body 64 and the engagement snap prong 68*b* can be formed as part of the cover 66. The cover 66 can be coupled to the anchor body 64 to prevent the energy-absorbing material 44 of the upper-body 40, such as EPS foam or EPS foam beads, from invading or being disposed within an open cavity or void within the strap anchor 60 that is configured to receive a portion of the strap 70 or the rod 74.

As shown in FIGS. 4A and 4B, the strap anchor 60 can be formed without a web or reinforcing member that is used as a reinforcing attachment point between a strap anchor and a helmet body, similar to the web 16 shown in FIG. 1. The web 16, or a similar web or structure can be omitted from the strap anchor 60, or cam be formed at a smaller or reduced size, for a number of reasons. First, the web 16 can be removed or eliminated due to coupling or placing the strap anchor 60 into direct contact with an outer shell of the multi-body helmet, such as with the outer shell 42 or the outer shell 52. Placing the strap anchor 60 into direct contact with an outer shell, such as a PC cap or similar structure, can increase strength of the strap anchor 60, and allow the outer shell to provide reinforcement in place of reinforcement from a web, such as web 16. Second, the web 16 can be removed or eliminated because of the positioning of the strap anchor 60 and the strap 70 between bodies of the multi-body helmet 30, such as upper-body 40 and the lower-boy 50. Positioning, sandwiching, or entrapping the strap anchor 60 and the strap 70 between the upper-body 40 and the lower-body 50 can place the strap 70 in compression and reduce a tension or force applied along the strap 70 to the strap anchor 60 itself, thereby reducing the need for a web coupled to the strap anchor 60.

By forming the strap anchors 60 without a web, a size of the strap anchor can be reduced with respect to conventional ski type strap anchors, such as strap anchor 10 shown in FIG. 1. As a non-limiting example, the strap anchor 60 can comprise a height H, a width W3, and a depth D, which taken together, yield a product that comprises a size or volume that is less than a size or volume of conventional strap anchors, such as the strap anchor 10. In an embodiment, the height H of the strap anchor 60 can be in a range of 10-30 mm, or 15-20 mm, or about 17 mm; the width W3 of the strap anchor 60 can be in a range of 10-50 mm, or 35-45 mm, or about 38 mm; and a depth D of the strap anchor 60 can be in a range of 2-10 mm, 4-7 mm, or about 5 mm. As such, a total volume occupied by the strap anchor 60 can be in a range of about 600-15,000 mm3. As such, embedding the strap anchors 60 within the multi-body helmet 30, such as within the energy-absorbing material 44, requires a size, area, or volume that is less than the size, area, or volume that would be required by a ski type strap anchor such as a ski type strap anchor 10 comprising a web 16. Accordingly, the use of the strap anchors 60 can be more versatile than conventional strap anchors like strap anchors 10, and the reduced size, area, or volume of the strap anchors 60 can allow for an increased number of placement options within a helmet without interfering with vent openings or other design constraints of the helmet.

Figure 4C:
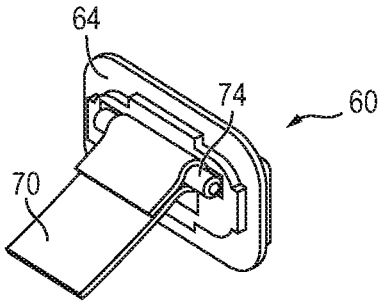
Figure 4D:
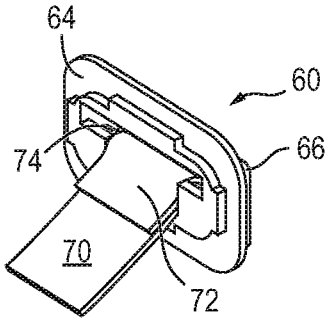
Figure 4E:
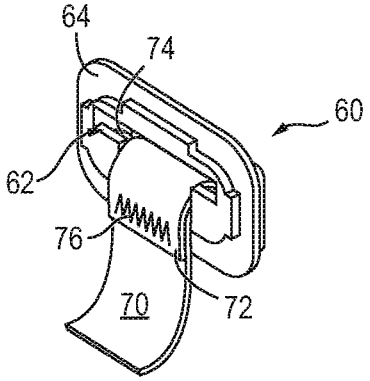

FIGS. 4C-4E show various steps in a process of attaching or coupling the strap 70 and the rod 74 to the strap anchor 60. First, FIG. 4C shows a perspective view of the rod 74 disposed within the loop 72 of the strap 70 just before the rod passes through the opening 62 in the anchor body 64. Second, FIG. 4D shows a perspective view of the strap 70 and the rod 74 after the rod 74 and a portion of the strap 70 and have passed through the opening 62 such that the rod 74 is contained within the strap anchor, and the width W2 of the anchor body 64 can prevent the rod 74 from being withdrawn from the strap anchor 60.

FIG. 4E shows a perspective view of the strap anchor 60 similar to the view shown in FIGS. 4C and 4D. FIG. 4E shows the rod 74 residing within the strap anchor 60 with the strap 70 laying flat and ready to be coupled to a user's head after passing through the lower-body portion 50. The strap 70, when passing between the upper-body 40 and the lower-body 50, can be sandwiched between the upper-body 40 and the lower-body 50. FIG. 4E also provides the additional detail of zig-zag stitching 76 in the strap 70 to form the loop 72 at an end of the strap 70 for receiving the rod 74. As a person of ordinary skill in the art will appreciate, any type of suitable stitching, weaving, mechanical, or chemical attachment can be used to form the webbing loop 72. Similarly, any type of suitable stitching, weaving, mechanical, or chemical attachment can be used to form the webbing 70 to include the loop 72 or other desirable structure for coupling or attaching the strap 70 to the strap anchor 60.

Figure 5:
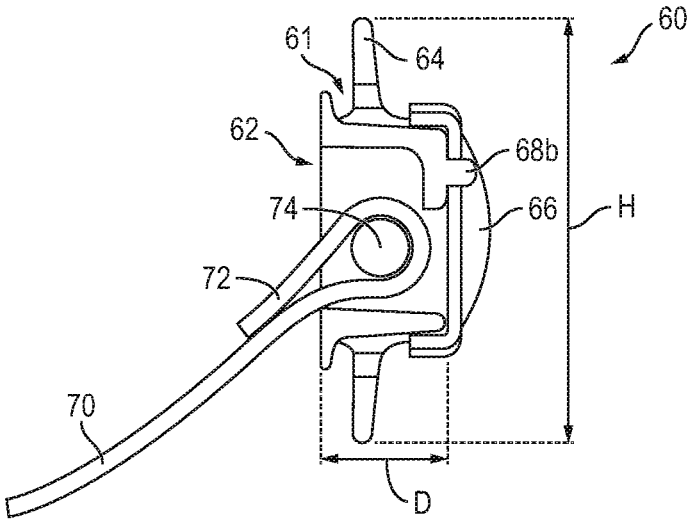
FIG. 5 shows a cross-sectional profile view of an anchor housing with a rod and webbing disposed within the anchor housing.

FIG. 5 shows a cross-sectional profile view of an embodiment of the strap anchor 60 that was shown previously in FIGS. 4A-4E. FIG. 5 shows rod 74 disposed within the strap anchor 60 and with the cover 66 coupled to the anchor body 64.

Figure 6:
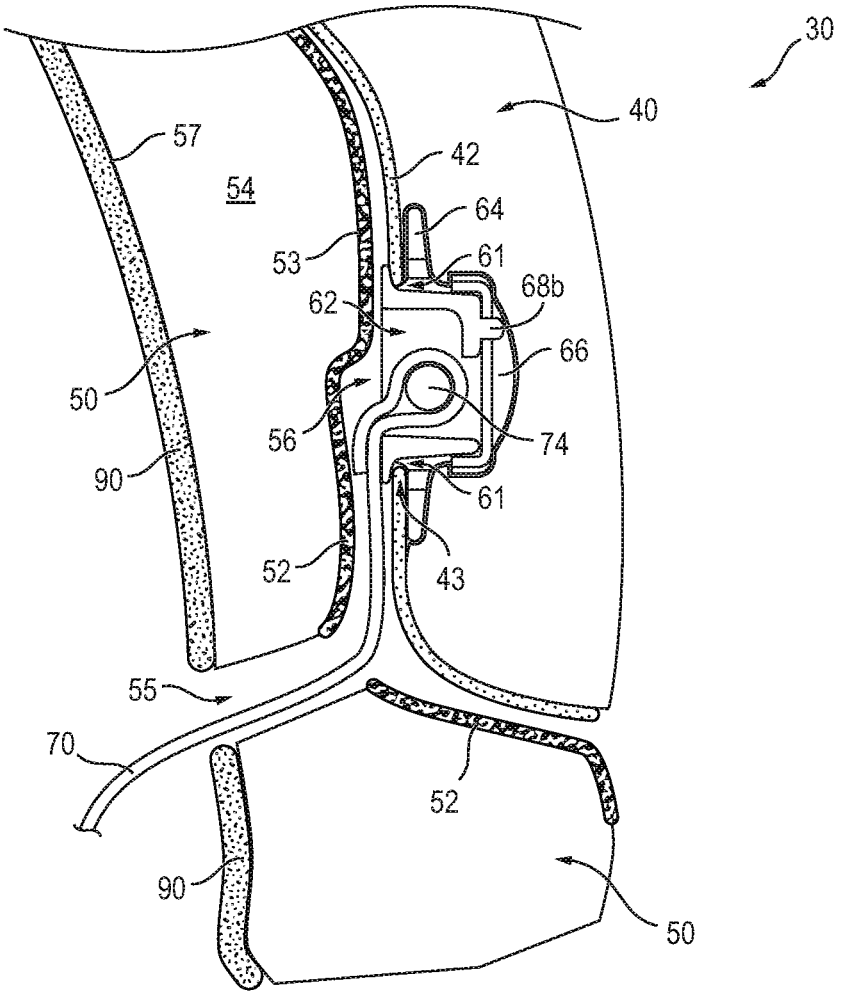
FIG. 6 shows a cross-sectional profile view of the anchor housing disposed within the multi-body helmet.

FIG. 6 shows a cross-sectional profile view of the strap anchor 60, shown previously in FIG. 5, disposed within the portion of the multi-body helmet 30 that is indicated by section-line 6 shown in FIG. 2A. The cross-sectional view of FIG. 6 is taken through the multi-body helmet 30 and through a center of one of the strap anchors 60. FIG. 6 shows detail of how the strap anchor 60 can be coupled to the strap 70, the strap 70 being disposed or sandwiched between the upper-body 40 and a lower-body 50. FIG. 6 also shows how multiple bodies within the multi-body helmet 30 can come together to sandwich and support the strap anchor 60 and to seal off the strap anchor 60 from the user or consumer. FIG. 6 further shows a non-limiting example in which one or more shells, such as the outer shell 42 on the upper-body 40 can be formed at the inner surface 46 of the inner body. In FIG. 6 the outer shell 52 is shown as being formed at an outer surface 53 of the lower-body 50 so that the outer shell 42 and the outer shell 52 can be disposed adjacent opposing sides to sandwich the strap 70.

FIG. 6 additionally shows a non-limiting example of how the strap anchor 60 can be coupled to the multi-body helmet 30. In FIG. 6, the outer shell 42 of the upper-body 40 is shown disposed or residing inside a groove or channel 61 disposed around the strap anchor 60. As shown in FIG. 6, the groove 61 around the strap anchor 60 can serve for mounting the strap anchor 60 within an opening of a shell, such as an opening 43 in the outer shell 42. Without limitation, the opening 43 in the outer shell 42 can be formed by punching the opening 43 in the outer shell 42, placing the strap anchor 60 with groove 61 in the opening 43, and then in-molding the energy-absorbing layer 44 around the strap anchor 60 as the strap anchor 60 is coupled to the outer shell 42. The opening 43 in the outer shell 42 can be sized with a specific size and shape approximately equal to, or slightly smaller than, a size and shape of the strap anchor 60. As such, the outer shell 42 can receive the strap anchor 60 and hold the strap anchor 60 in place during subsequent formation or molding of the energy-absorbing layer 44, so that the energy-absorbing layer 44 can be disposed adjacent the outer shell 42 and around the strap anchor 60.

In some embodiments, formation of the strap anchor 60 within in the multi-body helmet 30 can be accomplished by a method similar to a method used for forming ski type strap anchors 10 within a conventional ski type helmet. The method used for mounting the strap anchors 60 within the multi-body helmet 30 can comprise mounting the strap anchors 60 on a blade that protrudes from a base of a male side of an EPS tool as part of an EPS press. As used herein, the use of "EPS" with respect to the EPS tool and the EPS press are exemplary and non-limiting, and as such other any suitable energy absorbing material that is contemplated herein. The blade can act as a sturdy mount for the strap anchor 60, while the blade can also evacuate or prevent the opening 62 within the strap anchor 60 from being filled with energy-absorbing material so that the opening 62 is readily available to subsequently receive the web 70, the rod 74, or both. After molding, the EPS press can open and the helmet can be taken from the tool and from a female side of the EPS press with the strap anchors 60 residing in the multi-body helmet 30. In some instances, mounting the strap anchor 60 to the male side of the EPS press can cause an orientation of blades, and consequently an orientation of the strap anchors 60, to be aligned with a pull direction of the EPS press as the EPS press opens and closes. By determining an orientation of the strap anchors 60 based on the pull direction of the EPS press, the resulting orientation of the strap anchors 60 can cause the straps 70 coupled to the strap anchors 60 to twist because a preferred alignment for the EPS press is different from a preferred alignment for causing the straps 70 to lie flat across the face of the user.

In other embodiments, the strap anchor 60 can be formed within in the multi-body helmet 30 by mounting the strap anchor 60 in any orientation with respect to an outer shell, such as the outer shell 42, without regard to a position or orientation of a pull direction of the EPS mold. By so doing, the position and orientation of the strap anchors 60 can be positioned and arranged, oriented, or aligned, at a relative angle of about 90 degrees to an applied load or an expected applied load. As such, the straps 70 can releasably couple the helmet 30 to the user's head while the straps 70 can be oriented to lie flatter on the face of the user, and to reduce or minimize twisting of the straps 70. More specifically, the nature and design of the strap anchor 60, including one or more of a small web, no web, a small overall size, and the groove 61, can allow for the strap anchor 60 to be held in a desired position with respect to the outer shell 42 wherever the openings 43 are formed in the outer shell 42. Accordingly, in some embodiments the strap anchors 60 can be positioned or aligned within the multi-body helmet 30 so that the rods 74 can be disposed within the strap anchors 60 in an orientation or direction that is perpendicular, transverse, or at a relative angle of about 90 degrees to a desired path of the strap 70. By so doing, securing the strap 70 with the rod 74 to the strap anchor 60, twisting of the strap 70 used for coupling the multi-body helmet 30 to the head of the user will be reduced. Furthermore, and as indicated above, attaching the strap anchor 60 to an outer shell of the upper-body 40, such as outer shell 42, improves strength of the strap anchor 60, allowing a decreased size of the strap anchor 60 and removal or omission of webs 16.

As shown in FIG. 6, the strap recess 56 between the upper-body 40 and lower-body 50 can be large enough and provide sufficient offset to accommodate the loop 72 and the strap 70 within the multi-body helmet 30 or between the upper-body 40 and lower-body 50 before the strap extends away from the helmet, such as through the strap opening 55 to interface with, or be coupled around, the helmet user's head, face, or chin. While FIG. 6 shows a non-limiting example in which the strap opening 55 is formed in the lower-body 50, the strap opening 55 can also be formed in the upper-body 40 or both the upper-body 40 and the lower-body 50.

FIG. 6 also shows a non-limiting example of an optional comfort liner or fit liner 90 that can be disposed inside the lower-body 50 adjacent the inner surface 57 of the lower-body 50. The comfort liner 90 can be made of textiles, plastic, foam, polyester, nylon, or other suitable materials. The comfort liner 90 can be formed of one or more pads of material that can be joined together, or formed as discrete components, that are coupled to the multi-body helmet 30. The comfort liner 90 can be releasably or permanently attached to the multi-body helmet 30, such as the lower-body 50, using an adhesive, permanent adhesive, PSA, foam-core adhesive, tape, two-sided tape, mounting foam adhesive, fastener, clip, cleat, cutout, tab, snap, rivet, hog ring, or hook and loop fasteners, or other interlocking surfaces, features, or portions. As such, the comfort liner 90 can provide a cushion and improved fit for the wearer of the in-molded helmet.

Figure 7:
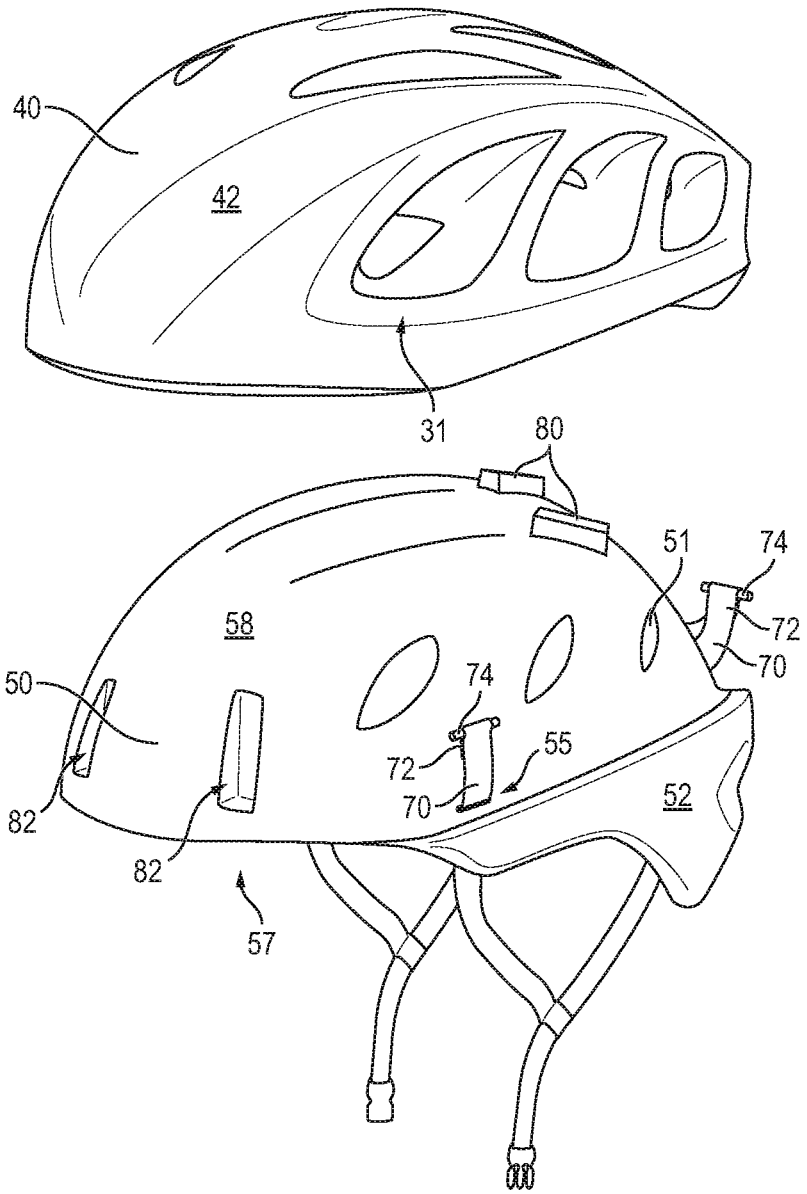
FIG. 7 shows an exploded perspective view of the lower-body being fit to the upper-body of the multi-body helmet.

FIG. 7 shows an exploded perspective view of the multi-body helmet 30, similar to the profile view of the multi-body helmet 30 shown in FIG. 2A. FIG. 7 additionally provides detail with respect to the straps 70 and a method of using the straps 70 for coupling the upper-body 40 and the lower-body 50 for achieving benefits a smaller size of the strap anchors 60, and a hidden position of the strap anchor 60. A method of coupling the straps 70 to the multi-body helmet 30 can comprise, as discussed above with respect to FIG. 6, coupling the strap anchor 60 to the outer shell 42. The energy-absorbing material 44 can then be formed adjacent the outer shell 42 and around the strap anchor 60. The cover 66 can be included as part of the strap anchor 60 to prevent a portion of the energy-absorbing material 44 from entering within the strap anchor 60 during formation of the energy-absorbing material 44, such as during an in-molding process. Keeping the energy-absorbing material 44 out of the strap anchor 60 prevents the energy-absorbing material 44 from interfering with the subsequent reception of the rod 74 and the strap 70 within the strap anchor 60. After formation of energy-absorbing layers 44 and 54, the straps 70 can then be coupled to the upper-body 40 and the lower-body 50 for bringing together the multi-body helmet 30 and for facilitating attachment of the multi-body helmet 30 to the head of the user.

The straps 70 can be coupled to the upper-body 40 and the lower-body 50 by forming the loop 72 in the strap 70, and passing the loop 72 through the strap openings 55 of the lower-body 50. A number of the strap openings 55 can correspond, or be identical, to a number of strap anchors 60 that are disposed at the inner surface 46 of the upper-body 40. Similarly, a position of the strap openings 55 can correspond to, and be aligned with, the strap anchors 60 that are disposed at the inner surface 46 of the upper-body 40. By way of example and not by limitation, the loops 72 can pass through corresponding strap openings 55 from within the lower-body 50 to without the lower-body 50 by passing from an inner surface 57 of the lower-body 50 to the outer-surface 58 of the lower-body 50 opposite the inner surface 57. After passing each of the loops 72 through the strap openings 55, a number of the rods 74 can be passed through each of the loops 72 of the straps 70. In some instances, the length L of the rods 74 can be greater than a length or opening size of the strap openings 55 so that the rods 74 must be placed within the loops 72 after the loops 72 have passed through the strap openings 55. In other embodiments, the length L of the rods 74 can be less than the length or opening size of the strap openings 55 so that the rods 74 can be placed within the loops 72 either before or after the loops 72 have passed through the strap openings 55. After the loops 72 in the straps 70 have passed through the strap openings 55 in the lower-body 50, and the rods 74 have been inserted into the loops 72, the rods 74 can be disposed within the openings 62 in the strap anchors 60 as shown in, and described with respect to, FIGS. 4A-4E.

With the straps 70 coupled to the strap anchors 60 and joining the upper-body 40 and the lower-body 50, the straps 70 can then be gradually pulled, removing slack and increasing tension in the straps 70, to draw the upper-body 40 and the lower-body 50 together to form a unitary multi-body helmet 30. While drawing the upper and lower bodies together, the upper and lower bodies can also be coupled or adhered to lower-body 50 using any suitable chemical or mechanical fastener, attachment device, or substance including without limitation, an adhesive, permanent adhesive, PSA, foam-core adhesive, tape, two-sided tape, mounting foam adhesive, fastener, clip, cleat, cutout, tab, snap, rivet, hog ring, or hook and loop fasteners, or other interlocking surfaces, features, or portions. Such interlocking features can limit, prevent, or regulate undesired relative movement between the multiple bodies such as the upper-body 40 and the lower-body 50. In some instances, a predetermined shear strength can be built into the interlocking features to shear or fail at predetermined levels of force. As a non-limiting example, the multi-body helmet 30 can comprise bumps or pop-outs 80 and 84 as well as indents 82 and 86 to assist in coupling together the upper-body 40 and the lower-body 50 together to form the multi-body helmet 30. More specifically, FIG. 7 shows the bumps 80 are formed on the outer surface 58 of the lower-body 50 so that the bumps 80 are configured, by size, shape, and position, to be mateably coupled with the indents 86 shown on inner surface 46 of the upper-body 40 in FIG. 3. FIG. 7 also shows the indents 82 can be formed on the outer surface 58 of the lower-body 50 so that the indents 82 are configured, by size, shape, and position, to be mateably coupled with the bumps 84 shown on inner surface 46 of the upper-body 40 in FIG. 3. The interlocking features of bumps 80 and 84 as well as indents 82 and 86 can help facilitate a stronger connection and better alignment between the upper-body 40 and the lower-body 50 of the multi-body helmet 30.

Figure 8A:
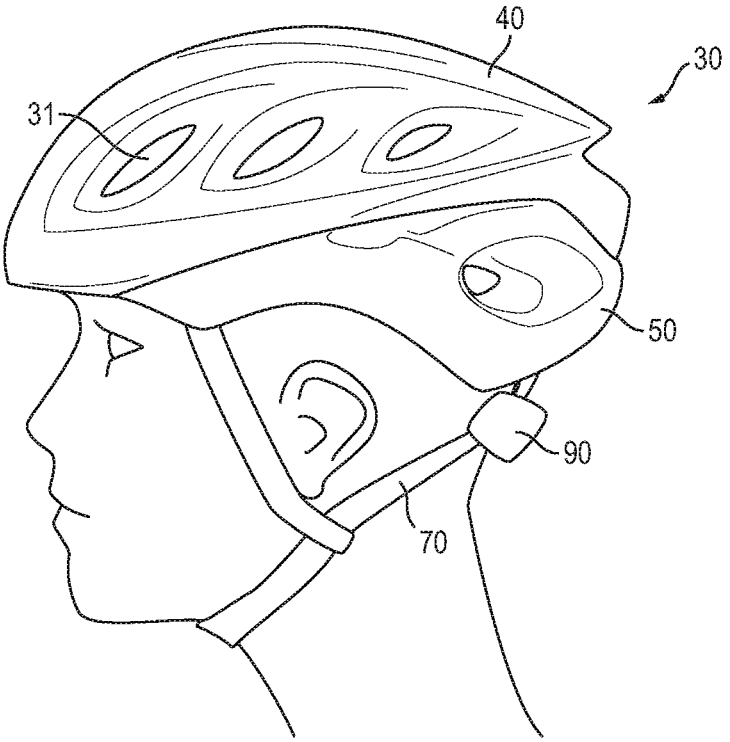
FIGS. 8A and 8B show views of the multi-body helmet being worn by a user.
Figure 8B:
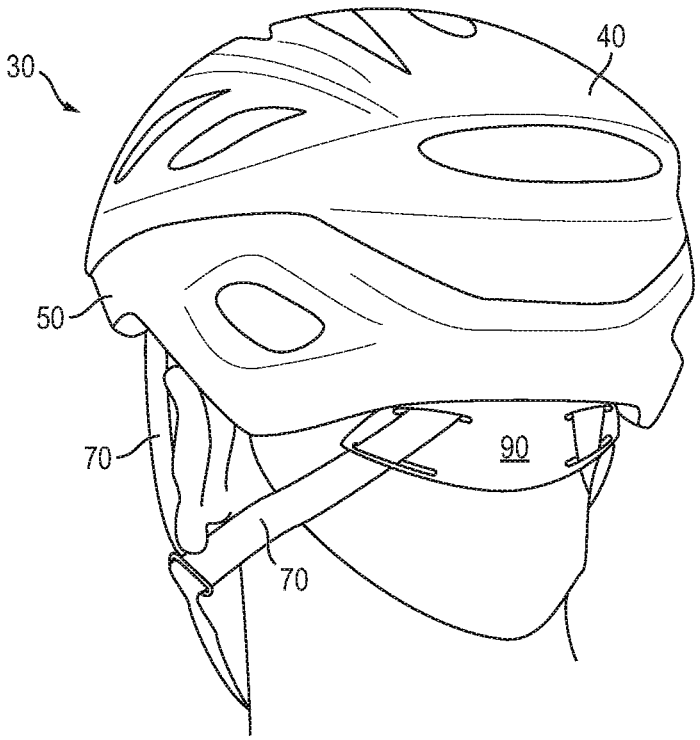

FIGS. 8A and 8B show various views of a user wearing the multi-body helmet 30 when the multi-body helmet is fully formed and comprising the upper-body 40 coupled together with the lower-body 50 with the straps 70. FIG. 8A shows a side profile view of the user having the multi-body helmet 30 coupled to the head of the user with the straps 70 laying flatly, and without twisting, on the face of the user. FIG. 8B shows a perspective view of a rear and left side portion of the multi-body helmet 30 as the multi-body helmet 30 is being worn by the user.

Attaching or coupling the upper-body 40 to the lower-body 50, through the straps 70, as well as through other chemical and mechanical attachment as described herein, provides a number of advantages for the multi-body helmet 30. First, the strap anchor 60 can be hidden from view, or not visible, by being sandwiched between the upper-body 40 and the lower-body 50, instead of being disposed at lower edges 48 of upper-body 40 or at lower edges of the lower-body 50. The hidden position of the strap anchors 60 can reduce, minimize, or eliminate a risk of the user tampering with, or harming, the strap anchor 60 or the connection between the strap 70 and the strap anchor 60. In some embodiments, in order for the user to be able to tamper with the attachment or coupling of the strap anchor 60 and the strap 70 the helmet would need to be damaged or destroyed, which would discourage most users from proceeding with such tampering. Additionally, by covering portions of the strap or webbing anchor systems including the strap anchors 60 and the straps 70, the strap or webbing anchor systems are not exposed to view so that an aesthetic of the helmet can improve. The helmet aesthetic can be improved inasmuch as strap or webbing anchor systems on an exterior of a helmet are generally considered unsightly.

Second, the multiple bodies of the multi-body helmet 30, such as the upper-body 40 and the lower-body 50, can be adjacent and closely aligned one with another so as to apply pressure to the strap anchors 60, thereby assisting in keeping the strap anchors securely in place within the multi-body helmet for securing the strap 70 to a body of the multi-body helmet 30.

Third, the strap anchors 60 can be formed as lightweight structures without a web, reinforcing attachments, fins, parachutes, or anchoring geometry, like the web 16, to reduce a size and weight of the strap anchors 60 as well as reducing an overall weight of the multi-body helmet 30. An ability to safely produce a minimalist design for the strap anchors 60 with sufficient strength to remain firmly coupled to the multi-body helmet 30 and the straps 70 can result, at least in part, from the support that the strap anchors 60 receive from multiple sources. First, the strap anchors 60 can receive strength from being in direct contact with an outer shell, such as a PC cap or similar structure. Second, the strap anchors 60 can receive strength from being sandwiched between the upper-body 40 and the lower-body 50. Additionally, reducing an overall profile of the strap anchors 60 can reduced design constraints and allow increased versatility in helmet design without creating concerns for the positioning of the strap anchors 60, such as with a position of the strap anchors 60 interfering with vents 31, or other helmet design features or elements of the multi-body helmet 30.

Fourth, the strap anchors 60 can be placed in a favorable orientation to contribute to reducing, minimizing, or eliminating undesired twisting of the straps 70 when the user wears the multi-body helmet 30. The favorable orientation of the strap anchors 60 can be achieved by forming the strap anchors 60 comprising a groove 61 around a perimeter and substantially parallel to a main plane of the strap anchors 60 that allow the strap anchors 60 to snap into the opening 43 in the outer shell 42 of the upper-body 50. A related advantage of the multi-body helmet 30 can comprise improved aerodynamics resulting from less webbing being exposed to airflow and wind movement around the helmet, thereby reducing movement, flapping, or flopping of the straps 70 in in the wind. A reduction of movement of the straps 70 can also reduce noise and irritation to a user wearing the multi-body helmet 30.

Fifth, the straps 70 can extend between, and be held in place by, multiple bodies of the multi-body helmet 30, such as the upper-body 40 and the lower-body 50. As a result, the straps 70 can be trapped or fixed in a desired alignment between multiple bodies of the multi-body helmet 30 such that tension along a length of the straps 70 can be reduced by applying a force of compression to the straps 70 when sandwiching the straps 70 between the multiple bodies of the multi-body helmet 30.

Sixth, an advantage of creating continuity between multiple helmet bodies to anchor or hold together the multiple bodies of the multi-body helmet 30 can be achieved by threading the straps 70 through the lower-body 50 and coupling the straps 70 to the strap anchors 60 in the upper-body 40. By threading the strap 70 through the lower-body 50 and securing the strap 70 to the upper-body 40, the strap anchors 60 can prevent the lower-body 50 and the upper-body 40 from separating from each other during an impact, thus increasing integrity of the multi-body helmet 30 during a crash. In some embodiments, by having the straps 70 threaded through and coupled to multiple bodies of the multi-body helmet 30, an impact or crash can increase tension in the straps 70 as a helmet is pulled or forced away from a user's head that in turn draws the multiple bodies of the multi-body helmet together, such as upper-body 40 and the lower-body 50.

Seventh, the strap anchor 60 can act as an improved strap bone to simplify and improve helmet function and helmet aesthetics. The improvements of the strap anchor 60 can include coupling the strap anchor to an outer shell of the helmet, such as the outer shell 42, to improve structural strength, while also being in-molded at an advantageous position with respect to the completed multi-body helmet 30 to reduce twisting of the straps 70. The advantageous position of the strap anchor 60 can also include hiding the strap anchor 60 from view of the user once the helmet is assembled, and reduce a likelihood of tampering with the strap anchor. The above improvements and advantages of the strap anchor 60 can be in contrast to conventional strap bones that are visible at an exterior of the helmet, and are placed with respect to molding considerations at the expense of strap position.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet comprising:

an upper-body comprising a first outer shell coupled to a first energy-absorbing shell;

a lower-body comprising a second outer shell separate from the first outer shell and coupled to a second energy-absorbing shell separate from the first energy-absorbing shell, wherein an upper-portion of the lower body is nested within and substantially coextensive with the upper-body;

a strap anchor disposed between the upper-body and the lower-body, the strap anchor comprising a housing with an opening formed through the housing and sized to receive a fastening device through the opening, wherein the strap anchor is sandwiched between the upper-body and the lower-body with the strap anchor being adjacent to, and oriented towards, the lower-body; and a strap coupled to the fastening device and coupled to the strap anchor, wherein the strap extends between the upper-body and the lower-body for coupling the helmet to a head of a user.

2. The helmet of claim 1, wherein the first energy-absorbing shell is formed of expanded polypropylene (EPP), expanded polystyrene (EPS), expanded polyurethane (EPU), or expanded polyolefin (EPO).

3. The helmet of claim 1, wherein the second energy-absorbing shell is formed of EPP, EPS, EPU, or EPO.

4. The helmet of claim 1, wherein the strap anchor comprises a height, width, and depth less than or equal to at least one of 10-30 millimeters (mm), by 10-50 mm, and by 2-10 mm.

5. The helmet of claim 1, wherein:

the strap anchor is formed without a web; and the strap anchor is sandwiched between the upper-body and the lower-body and hidden from view within the helmet.

6. The helmet of claim 1, wherein the strap anchor is disposed within the upper-body such that the strap anchor opening is substantially coplanar with an inner surface of the upper-body and offset from a lower edge of the upper-body.

7. The helmet of claim 1, wherein:

the first energy-absorbing material hasving a density in a range of 70-100 g/L; and the second energy-absorbing material hasving a density in a range of 50-80 g/L.

8. The helmet of claim 1, wherein:

the fastening device comprises a rod defining a length L; and the opening defines a first width W1 greater than the length L, and a second width W2 less than the length L.

9. The helmet of claim 1, wherein the one of the inner surface of the upper-body and the outer surface of the lower-body define one or more bumps configured to be mateably coupled with one or more indents in the other of the inner surface of the upper-body and the outer surface of the lower-body.

10. A helmet comprising:

an upper-body comprising a first outer shell coupled to a first energy-absorbing shell;

a lower-body comprising a second outer shell separate from the first outer shell and coupled to a second energy-absorbing shell separate from the first energy-absorbing shell, nested within and substantially coextensive with the upper-body;

a strap anchor disposed in the upper-body and comprising a housing defining an opening formed through the housing and sized to receive a fastening device through the opening, wherein the strap anchor is adjacent to, and oriented towards, the lower-body; and a strap coupled to the fastening device and coupled to the strap anchor, wherein the strap extends between the upper-body and the lower-body for coupling the helmet to a head of a user.

11. The helmet of claim 10, wherein the first energy-absorbing shell is formed of expanded polypropylene (EPP), expanded polystyrene (EPS), expanded polyurethane (EPU), or expanded polyolefin (EPO).

12. The helmet of claim 10, wherein the second energy-absorbing shell is formed of EPP, EPS, EPU, or EPO.

13. The helmet of claim 10, wherein the strap anchor comprises a height, width, and depth less than or equal to at least one of 10-30 millimeters (mm), by 10-50 mm, and by 2-10 mm.

14. The helmet of claim 10, wherein:

the strap anchor is formed without a web; and the strap anchor is sandwiched between the upper-body and the lower-body and hidden from view within the helmet.

15. The helmet of claim 10, wherein the strap anchor is disposed within the upper-body such that the strap anchor opening is substantially coplanar with an inner surface of the upper-body and offset from a lower edge of the upper-body.

16. The helmet of claim 10, wherein:

the first energy-absorbing material has a density in a range of 70-100 g/L; and the second energy-absorbing material has a density in a range of 50-80 g/L.

17. The helmet of claim 10, wherein the fastening device comprises a rod.

18. The helmet of claim 17, wherein the rod defines a length L; and the opening defines a first width W1 greater than the length L, and a second width W2 less than the length L.

19. The helmet of claim 10, wherein the one of the inner surface of the upper-body and the outer surface of the lower-body define one or more bumps configured to be mateably coupled with one or more indents in the other of the inner surface of the upper-body and the outer surface of the lower-body.

20. The helmet of claim 10, further comprising a cover coupled to the strap anchor.

* * * * *